United States Patent [19]

Brackmann

[11] Patent Number: 4,970,746

[45] Date of Patent: Nov. 20, 1990

[54] GOLF BALL WASHER

[76] Inventor: Rogers F. Brackmann, 27 W. 145 Mack Rd., Wheaton, Ill. 60187

[21] Appl. No.: 476,156

[22] Filed: Feb. 7, 1990

[51] Int. Cl.[5] ..... A63B 47/04

[52] U.S. Cl. ..... 15/21.2; 15/3.2

[58] Field of Search ..... 15/21 A, 3.13, 3.16, 15/3.19, 3.2, 97 R

[56] References Cited

U.S. PATENT DOCUMENTS

| | | | |
|---|---|---|---|
| 703,916 | 7/1902 | Haley | 15/3.2 X |
| 3,038,186 | 6/1962 | Davy . | |
| 3,084,360 | 4/1963 | Hasselroth . | |
| 3,099,027 | 7/1963 | Illo . | |
| 3,981,039 | 9/1976 | Rumph . | |
| 4,011,619 | 3/1977 | Michalak . | |
| 4,701,968 | 10/1987 | Stoltzman . | |

FOREIGN PATENT DOCUMENTS

| | | | |
|---|---|---|---|
| 50309 | 2/1910 | Switzerland | 15/3.2 |

*Primary Examiner*—Edward L. Roberts

*Attorney, Agent, or Firm*—The Dulin Law Firm

[57] ABSTRACT

A washer for balls such as golf balls including an entry tube having an open entrance end and a second end joined at an angle to an adjoining end of an exit tube thereby forming an elbow-shaped housing. The exit tube has an inner wall lined with brushes near the adjoining end and sponges near the exit end. A rotatable helical (spiral) array of brushes, or/and sponges, is arranged inside of and concentric with the exit tube. The washer is supported with the entrance and exit above the joining ends so that the housing will hold water up to a level that is determined by a weep hole to keep the brushes submerged. The helical array of brushes can be turned manually by a crank extending from the central shaft of the helical brush array to function as a lift mechanism. Balls are inserted into the entrance end of the housing and as the handle is turned, the ball is scrubbed as it is lifted by the helical brush array toward the exit end of the housing onto a sponge-lined tray having weep holes therein.

20 Claims, 2 Drawing Sheets

GOLF BALL WASHER

FIELD:

This invention relates to a field-use golf ball washer and particularly to a washer wherein rotary motion of a screwlike configuration of brushes concentrically positioned within a brush-lined cylindrical chamber provides a scouring action to the surface of a golf ball while lifting the ball from an entry port through a washing stage, a drying stage and out an exit port onto a delivery tray.

BACKGROUND AND INFORMATION DISCLOSURE STATEMENT:

Washers for golf balls are in demand at country clubs and driving ranges where it is necessary to clean the balls that have become soiled in use so the encrusted dirt does not affect critical hitting, flight and rolling characteristics.

A number of golf ball washers have been disclosed in the patent literature in which a ball is passed along a helical path on the inside wall of a cylindrical changer where it is scrubbed by an array of brushes.

For example, U.S. Pat. No. 3,099,027 to Illo is for a golf ball washer in which a cylindrical brush rotates in a cylindrical housing to scrub and move the ball from an entry end of the cylinder, along a helical ramp on the internal cylindrical wall, and out an exit end.

U.S. Pat. No. 3,038,186 to Davy is similar to the Illo invention with the addition that the balls roll by gravity down a chute into the bottom port of a vertical cylindrical housing containing a washing fluid (e.g., soapy water) and a rotating brush which scrubs the ball while forcing the ball to roll up a helical ramp to an upper exit ramp.

U.S. Pat. No. 4,011,619 to Michalak is for a washer comprising a cylindrical brush rotating within the chamber to scrub the ball while driving the ball through three compartments of a chamber, the last being a drying chamber.

Another style is exemplified by U.S. Pat. No. 4,701,968 to stolzman which is for a hand held washer in which the ball is inserted into a chamber and sprayed.

Yet another style resembles a "cake tin" configuration in which a generally disk-shaped brush array is rotated by a hand crank so as to urge the ball to follow a circular circumferential path inside a circular housing.

An example of this style of washer is U.S. Pat. No. 3,981,039 to Rumph which comprises a "cake tin" housing with paddles concentrically arranged within the housing, so that the array of paddles can be rotated, thereby forcing the ball to make scrubbing contact with the brush-lined inner wall of the circular housing.

U.S. Pat. No. 3,084,360 to Hasselroth discloses a washer having a "cake-tin"-shaped housing in which a brush lined disk is rotated by a hand crank to cause the ball to follow a circumferential path within the chamber.

Several drawbacks are inherent in the devices of the prior art. One drawback resides in recognizing that two surfaces are required to move the ball from an entrance, through a chamber and out an exit. One surface is part of a driving element (e.g., the surface of a rotating brush). The second surface is part of a guiding element (e.g., the helical ramp on the inside wall of a cylindrical chamber). In all of those disclosures, only one of these surfaces has a brush-like surface that can perform the scrubbing action in contact with the surface of the ball. The ball would therefore tend to skid on the "bare" surface thereby reducing the scrubbing action.

A second drawback is that each of those devices is constructed so that it cannot include all of the features that are desireable for the ball washer. For example, the Davy patent has an automatic feed capability but no drying capability, while the Michalak invention has a drying capability but is not constructed to incorporated automatic feed provision.

A third drawback is that there is no provision in devices of these patents for maintaining a constant level of water within the chamber in order to separate a washing area from a drying area.

A fourth drawback is that none of those devices have a satisfactory arrangement for drying the ball since even those disclosures that have a drying arrangement (e.g., Michalak) would soon accumulate enough water in the "drying" compartment to render the drying feature inoperative.

THE INVENTION

Objects:

It is an object of this invention to provide a washer for golf balls that combines washing and drying features with a simple means for inserting a continuous supply of balls into the washer.

Another object is to provide a washer that is easily portable and installable in the field adjacent a green or tee.

Another object is to exert scrubbing action against the surface of the ball that is more effective in removing stubborn stains and dirt than devices of the prior art.

Another object is to incorporate a drying feature wherein the water that would otherwise accumulate in the drying zone is separate from the drying zone so that the effectiveness of the drying action is not diminished as the number of balls passed successively through the washer increase.

DRAWINGS:

FIG. 1 shows one embodiment of the ball washer of this invention in vertical section to show the helical array of brushes and sponges.

FIG. *2a* is the same as in FIG. 1 except that the exit tube of the housing is expanded to provide more room for the brushes and sponges.

FIG. *2b* shows the expanded exit tube of FIG. *2a* wherein the entire interior wall of the exit tube and entire length of the rotating shaft inside the exit tube is lined with brushes.

SUMMARY:

This invention is directed toward a ball washer in which balls drop into an entrance to a rotating array of helically-arranged spiral brushes which lifts or pushes the ball through a wet stage and a dry stage while simultaneously scrubbing the balls in cooperation with brushes attached to the interior surface of the washer housing.

The washer housing is an "elbow"-shaped tube wherein one end of the elbow is an entrance and the other end is an exit. The "elbow" housing is oriented so that the bend of the elbow is below the level of the open ends thereby allowing the tubular elbow junction to hold water. The water level is maintained at a desired level by a "weep" hole at an appropriate location on either or both legs. Washing of the balls occurs in the region within the elbow below the water line and drying occurs above the water line. The exit leg has a shaft down its center to which is radially attached a helical array of brushes. The shaft extends out of the end of the exit leg and is attached to a crank so that the shaft with its array of brushes can be rotated manually. Fixed scrub brushes line the interior wall of the housing below the waterline. Drying sponges line the interior wall of the housing above the waterline (and preferably sponges are also attached to the rotating shaft above the waterline) in order to dry the ball as it passes to the housing exit. The balls are pushed through the exit tube by rotation of the helical array of brushes while scrubbing action is exerted by the combination of the brushes on the interior wall of the housing and brushes attached to the central rotating shaft.

DETAILED DESCRIPTION OF THE BEST MODE:

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
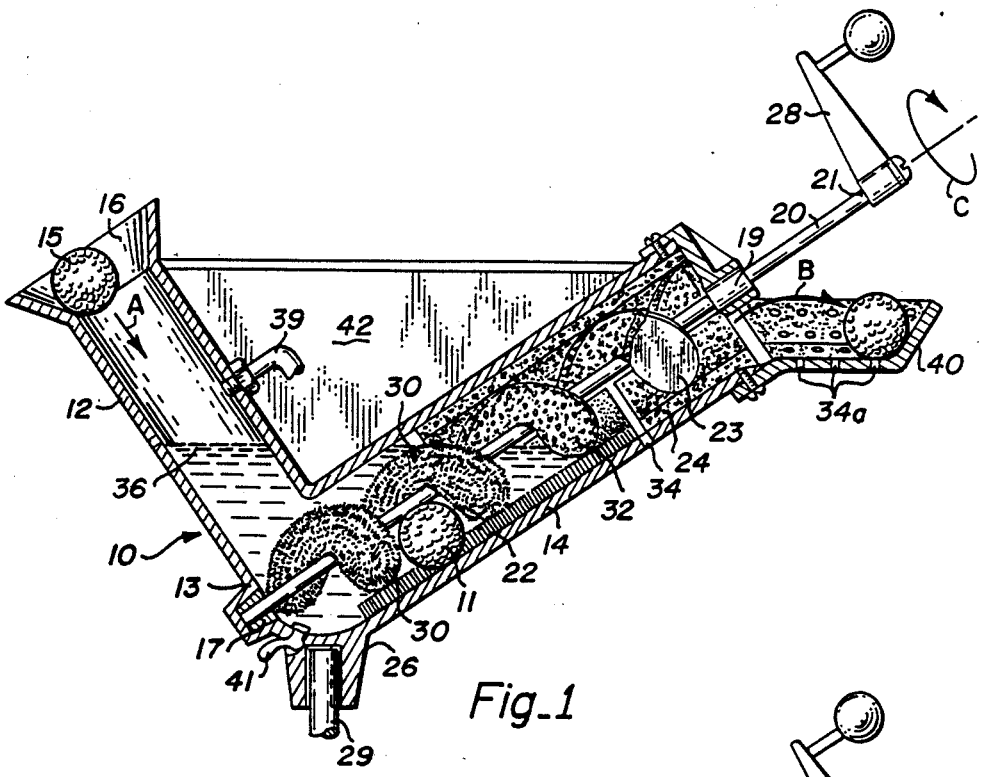

Turning now to a description of the drawings, FIG. 1 shows (in cross section) an elbow-shaped tubular housing 10 including an inclined entry tube 12 joined at its lower end 13 to an exit tube 14. A port, 39, for admitting water to the housing is shown. The ball 15 enters the open end 16 (arrow A) of the entry tube 12 and rolls into the wash and dry stations in the exit tube 14, then out of the exit end 18 onto delivery tray 40 (arrow B). A rotatable shaft 20 (arrow C) is rotatably supported within the exit tube by bushings 17 and 19 at opposite ends of the exit tube. One end 21 of the shaft extends out of the exit end and is attached to a hand crank 28. A helical array of brushes 30 is attached to the first section of the shaft adjacent to the joining ends of the tubes, and a helical array of sponges 32 is attached to a second section of the shaft adjacent to the exit.

The helical array of brushes and/or sponges may include a helical rigid support 23 lined with brushes and sponges respectively. (The sponge is partially cut away to reveal the rigid support 23.) The length of inner wall of the exit tube adjacent to the spiral brushes is lined with a brush 22 and the length of inner wall of the exit tube adjacent to the spiral array of sponges is lined with sponge 24.

The washer is supported on a threaded nipple 26 attached to the exterior of the housing and screwed onto an upright ground stake or post 29.

The housing is oriented with the exit end 18 and entry end 16 above the joined ends 13. Therefore the washer will hold water up to a level determined by a weep hole 34. The water line 36 is indicated.

In operation, a ball 15, dropped into the entry port 16 rolls into the elbow joinder 13 of the ball entry and exit tubes. When the crank handle 28 is turned, the ball 11 is caught up in the spiral array of brushes and is thereby lifted toward the exit 18. While passing through exit tube 14 the ball is at first immersed in water and scrubbed by contact with the brushes of the helical array and the brushes lining the wall in the first section of the exit tube. As the ball continues toward the exit, is passes in contact with the sponges which wipe or absorb water off the surface of the ball. The ball is dropped into sponge-lined exit tray 40 which also has weep holes **34*a*** which drain excess water from the tray.

FIG. **2*a* shows an embodiment similar to FIG. 1 except that the body 38 of the exit tube 14** is expanded in order to accommodate a thicker brush lining on the inner wall.

Figure 2:
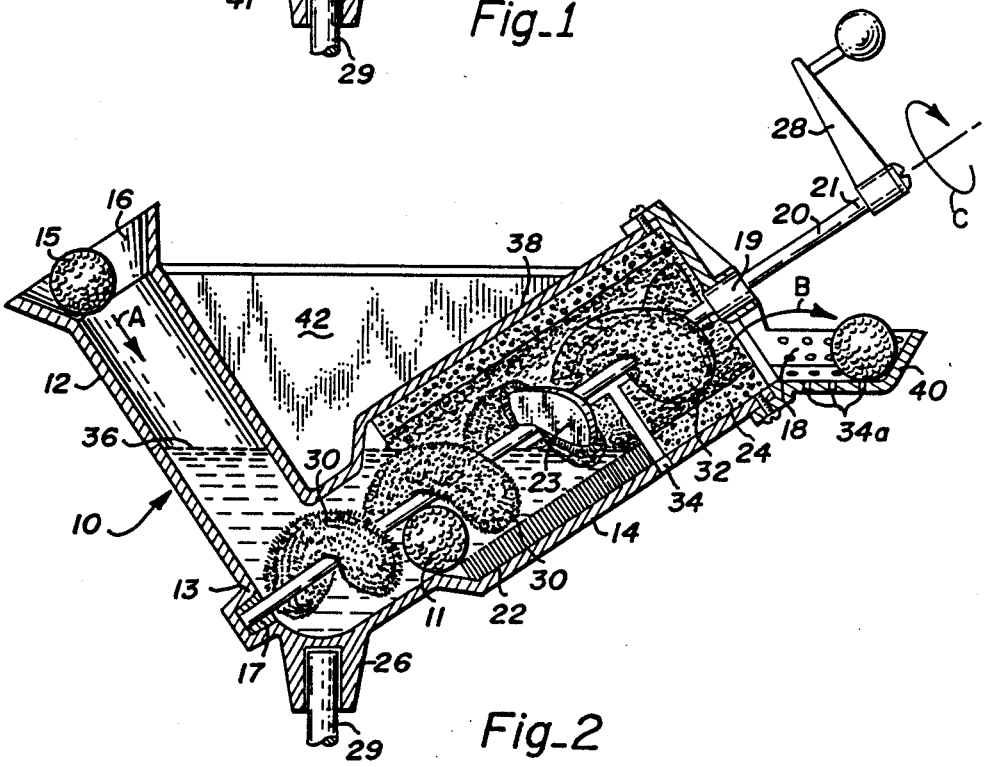
Figure 2B:
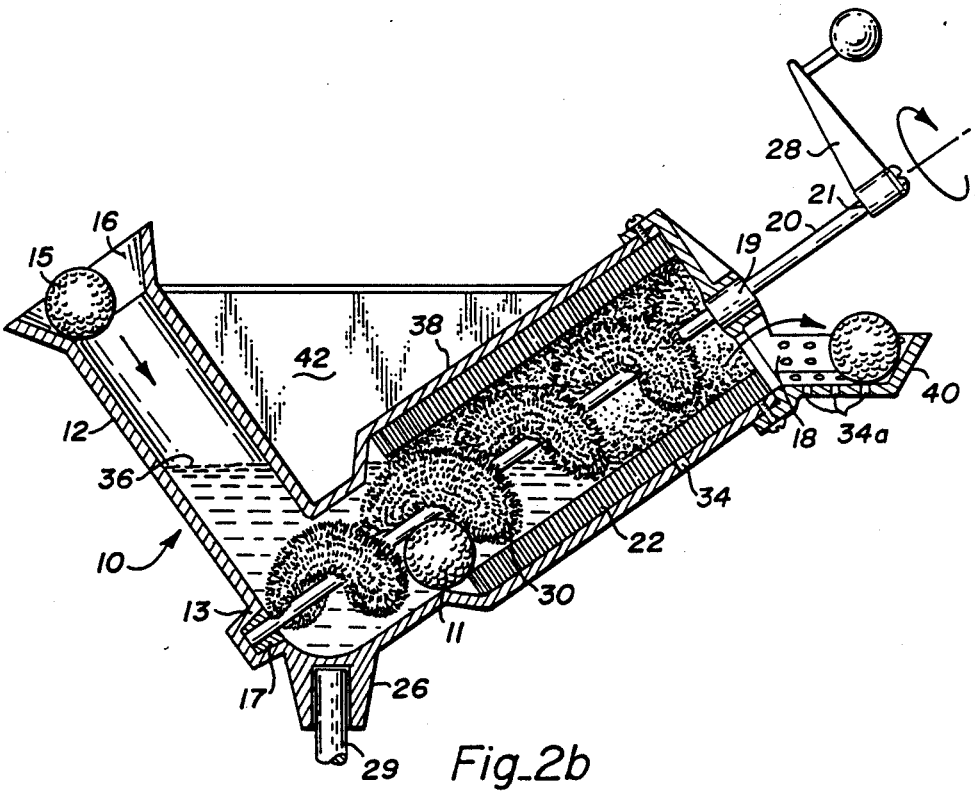

FIG. **2*b* is similar to FIG. 2*a*** except that the helical array and interior wall of the exit tube is entirely lined with brushes.

The embodiments of FIG. 1, **2*a* and 2*b*** have a number of important advantages.

One advantage is that both the surface that "pushes" the ball (the helical brush array) and the surface that guides the ball (the brush lining of the interior wall) operate in combination to scrub the ball. They act, counter to each other to provide an excellent scrubbing action. The lifting action scrubs at least two sides of the ball at once, the helical lifter side and the wall contact side.

Another advantage is that the level of washing fluid is controlled by the "weep" hole 34 which provides an operable scrubbing region separate from the drying region. Water is provided through pipe 39 which may be a small plastic line tapped into the ubiquitous sprinkler system at the golf course. The line 39 typically has a shut off valve (not shown). Drain hole 41 is conveniently closed with a rubber plug having a tab for ease of grasping (FIG. 1).

Other advantages include simplicity of construction and maintenance. The washer is readily portable and easy to operate.

In the foregoing paragraphs, a portable washer for balls has been described which satisfied the objects of portability and improved washing and drying capability. These objects are accomplished through features which include a tubular elbow shaped housing supported to maintain a constant liquid level enclosing a helical array of brushes which may be rotated by hand to simultaneously scrub the surface of the ball while moving it through the housing toward an exit end where it is dried. It will be recognized that the principles of the invention incorporated in the construction of this washer could be useful for cleaning objects other than golf balls whose shape would accommodate the requirements of the construction of the washer.

It should be understood that various modifications within the scope of this invention can be made by one of ordinary skill in the art without departing from the spirit thereof. For example, the transverse strengthening web 42 (FIG. 1) may be omitted. I therefore wish my invention to be defined by the scope of the appended claims as broadly as the prior art will permit, and in view of the specification if need be.

I CLAIM:

1. A ball washer for washing a succession of identical balls which comprises in operative combination:

(a) a housing forming a chamber having an entry section with an entry port joined substantially at right angles to an exit section having an exit port to define an elbow oriented to retain a washing fluid at the elbow junction of the entry and exit sections;

(b) a shaft rotatably supported within said exit section;

(c) a helical array of brushes radially attached to said shaft;

(d) a layer of brushes lining said exit section disposed adjacent to said helical array;

(e) means for supporting said washer with said entry and exit ports above said elbow junction thereby enabling said chamber to hold washing liquid; and (f) means for rotating said shaft to move said objects admitted through said entry port into said washing fluid retained in said elbow toward said exit port while said objects are scrubbed by contact with both said rotating array and said brush layer.

2. A ball washer as in claim 1 which includes:

(a) a layer of washing fluid absorbing means lining said exit chamber adjacent to said exit port above said washing fluid to dry said objects washed as they pass thereover to said exit port.

3. A ball washer as in claim 2 which includes:

(a) a helical array of means for absorbing washing fluid disposed attached to said shaft adjacent to said exit port;

4. A ball washer as in claim 3 wherein said housing includes a weep hole to establish a maximum liquid level in said chamber.

5. A ball washer as in claim 4 which includes means for introducing washing liquid to said chamber.

6. A ball washer as in claim 4 wherein said balls are golf balls and said entry and exit sections are tubes, each tube having an end joined to an end of said other tube thereby forming said elbow shaped housing, and said tubes are sized to provide brushing contact of said ball by both the wall brushes and the helical lift brushes.

7. A ball washer as in claim 6 wherein:

(a) said shaft has an end protruding from said exit end; and (b) said means for rotating said shaft is a crank handle attached to said shaft end.

8. A ball washer as in claim 6 which includes:

(a) a tray adjacent said exit port onto which said balls after washing are dumped.

9. A ball washer as in claim 8 wherein said tray includes means for drying said ball lining said tray, and at least one weep hole therein.

10. A ball washer as in claim 3 wherein said balls are golf balls and said entry and exit sections are tubes, each tube having an end joined to an end of said other tube thereby forming said elbow shaped housing, and said tubes are sized to provide brushing contact of said ball by both the wall brushes and the helical lift brushes.

11. A ball washer as in claim 3 wherein said drying means is at least one sponge member.

12. A ball washer as in claim 3 wherein said supporting means is a threaded nipple attached to said housing that may be screwed onto a supporting pole.

13. A ball washer as in claim 2 wherein said balls are golf balls and said entry and exit sections are tubes, each tube having an end joined to an end of said other tube thereby forming said elbow shaped housing, and said tubes are sized to provide brushing contact of said ball by both the wall brushes and the helical lift brushes.

14. A ball washer as in claim 13 which includes:

(a) a tray adjacent said exit port onto which said balls after washing are dumped; and (b) said tray includes means for drying said ball lining said tray, and at least one weep hole therein.

15. A ball washer as in claim 1 wherein said housing includes a weep hole to establish a maximum liquid level in said chamber.

16. A ball washer as in claim 1 which includes means for introducing washing liquid to said chamber.

17. A ball washer as in claim 1 wherein said balls are golf balls and said entry and exit sections are tubes, each tube having an end joined to an end of said other tube thereby forming said elbow shaped housing, and said tubes are sized to provide brushing contact of said ball by both the wall brushes and the helical lift brushes.

18. A ball washer as in claim 1 wherein:

(a) said shaft has an end protruding from said exit end; and (b) said means for rotating said shaft is a crank handle attached to said shaft end.

19. A ball washer as in claim 1 which includes:

(a) a tray adjacent said exit port onto which said balls after washing are dumped.

20. A ball washer as in claim 19 wherein said tray includes means for drying said ball lining said tray, and at least one weep hole therein.

* * * * *